US007832236B2

(12) United States Patent
Hong et al.

(10) Patent No.: US 7,832,236 B2
(45) Date of Patent: Nov. 16, 2010

(54) FOAM SENSOR OF DRUM WASHING MACHINE

(75) Inventors: Sog Kie Hong, Seoul (KR); Soo Young Oh, Seoul (KR); Kyung Seop Hong, Inchun-si (KR)

(73) Assignee: LG Electronics Inc., Seoul (KR)

( * ) Notice: Subject to any disclaimer, the term of this patent is extended or adjusted under 35 U.S.C. 154(b) by 611 days.

(21) Appl. No.: 11/447,285

(22) Filed: Jun. 6, 2006

(65) Prior Publication Data

US 2007/0012074 A1 Jan. 18, 2007

(30) Foreign Application Priority Data

Jun. 8, 2005 (KR) ..... 10-2005-0048870

(51) Int. Cl.
*D06F 39/00* (2006.01)
*D06F 33/02* (2006.01)

(52) U.S. Cl. ..... 68/12.21; 68/12.27

(58) Field of Classification Search ..... 68/12.21, 68/20, 23.5, 24, 12.27
See application file for complete search history.

(56) References Cited

U.S. PATENT DOCUMENTS 5,038,586 A * 8/1991 Nukaga et al. ..... 68/12.01
5,768,730 A * 6/1998 Matsumoto et al. ..... 8/159
2005/0081308 A1* 4/2005 Kim et al. ..... 8/158
2005/0081572 A1 4/2005 Park et al.

FOREIGN PATENT DOCUMENTS

CN 2399432 10/2000
CN 1609327 4/2005
JP 2003-260290 A 9/2003

* cited by examiner

*Primary Examiner*—Joseph L Perrin
(74) *Attorney, Agent, or Firm*—McKenna Long & Aldridge LLP

(57) ABSTRACT

A foam sensor of a drum washing machine is constructed such that a pair of temperature electrode terminals and a foam electrode terminal are supplied with electricity by a single connector, and thus is able to sense an electrical connection by a signal change of the temperature electrode terminals, in a case where electrical connection of the foam electrode terminal is cut off, thereby preventing a false sensing of foam generation caused by electrical short-circuiting of the foam electrode terminal. Furthermore, the foam electrode terminal is provided integral with the connector, and the temperature sensor portion has a thermistor for sensing a temperature of washing water and temperature electrode terminals inserted into the connector, the thermistor and the temperature electrode terminals being connected by a cord, which makes installation easier.

6 Claims, 6 Drawing Sheets

FOAM SENSOR OF DRUM WASHING MACHINE

This application claims the benefit of Korean Patent Application No. 10-2005-0048870, filed on Jun. 8, 2005, which is hereby incorporated by reference for all purposes as if fully set forth herein.

BACKGROUND OF THE INVENTION

1. Field of the Invention

The present invention relates to a foam sensor of a drum washing machine, which can sense if a foam electrode terminal is electrically short-circuited, and freely select an installation location of a thermistor and of the foam electrode terminal, and a drum washing machine having the same.

2. Description of the Related Art

Generally, a washing machine is an apparatus for removing contaminants stained on clothes, bedclothes or the like (hereinafter, referred to as "laundry") by the action of detergent-dissolved water or clean water (hereinafter, referred to as a "washing water").

FIG. 1 is a front cross sectional view schematically illustrating the interior of a drum washing machine according to the related art. Referring to FIG. 1, the drum washing machine according to the related art includes a cabinet 2, a tub 4 mounted in the cabinet 2 for containing washing water therein, a drum 6 rotatably disposed in the tub 4 for accommodating linen, and a motor (not shown) for rotating the drum 6.

To the tub 4, a water supply device 8 for supplying the washing water from the outside into the tub 4 and a drainage device 10 for draining the washing water in the tub 4 to the outside are connected.

The drainage device 10 includes a drainage hose 11 connected to a lower portion of the tub and a drainage pump connected to the drainage hose 11.

The washing machine further includes a pressure sensor 14 installed for sensing the level of the washing water supplied into the tub 4, a pressure chamber 16 formed at a lateral side of the drainage hose 11, and a water pressure transmitting portion 18 connecting between the pressure sensor 14 and the pressure chamber 16 so as to transmit the pressure of the washing water to the pressure sensor 14.

A method for sensing foam of the thus-constructed drum washing machine according to the related art will now be described below.

When a power is applied to the drum washing machine, washing water flows into the tub 4 through the water supply device 8. When the washing water fills up the tub 4, a pressure is formed in the pressure chamber 16, and the pressure in the pressure chamber 16 changes according to the level of the washing water.

Hence, the pressure sensor 14 senses a pressure change in the pressure chamber 16 through the pressure transmitting portion 18, and accordingly a control unit (not shown) determines a washing water level.

If excessive foam is generated in the tub due to an excessive use of detergent or the like at the time of washing, the pressure in the tub 4 rises to more than a predetermined value.

That is, since the pressure in the tub 4 increases as the pressure of the washing water and the pressure of the foam are added, it is determined if excessive foam is generated according to a change in the value sensed by the pressure sensor 14. Thus, once it is determined that excessive foam is generated, a foam removal operation in which water supply and drainage are repeated is performed.

However, the drum washing machine according to the related art is constructed so as to sense if excessive foam is generated only when the pressure in the tub 4 rises to more than a predetermined value. Accordingly, foam can be sensed only after foam fills up the tub 4. Therefore, the foam reduction operation is lengthened, which takes a lot of washing time and cost, and which cannot prevent the risk of fire caused by corrosion of peripheral parts, electrical leakage, etc.

In recent times, a foam sensor formed of an electrode terminal for sensing foam is used. However, in a case where a connecting line of the foam sensor is cut off or a poor connection occurs or the like, it is determined that no foam is generated, thereby failing to prevent the generation of excessive foam.

SUMMARY OF THE INVENTION

Therefore, an object of the present invention is to provide a foam sensor of a drum washing machine, which can more quickly and accurately sense if foam is generated and if the electrical connection of the foam sensor is defective, and a drum washing machine having the same.

To achieve the above object, the foam sensor of a drum washing machine according to the present invention includes: a temperature sensor portion for sensing a temperature of washing water supplied into a tub; a connector connected to the temperature sensor portion; and a foam electrode terminal provided integral with the connector, for sensing foam generated in the tub.

The temperature sensor portion includes: a thermistor for sensing a temperature of washing water; and temperature electrode terminals connected to the thermistor and inserted into the connector.

The temperature sensor portion further includes a temperature sensor housing formed so as to surround the thermistor.

The foam electrode terminal is formed in plural.

The connector includes: a receptacle provided integral with the foam electrode terminal and having a terminal slot for inserting the temperature electrode terminals; and a plug coupled to the rear part of the receptacle, for supplying a current to the foam electrode terminal and the temperature electrode terminals.

One end of the foam electrode terminal is inserted and fixed to the terminal slot, and the other end thereof is formed to be exposed to the outside of the connector.

The connector has a foam sensor housing formed so as to surround part of the foam electrode terminal.

The drum washing machine according to the present invention includes: a foam sensor having a temperature sensor portion for sensing a temperature of washing water supplied into a tub, a connector connected to the temperature sensor portion, and a foam electrode terminal provided integral with the connector, for sensing foam generated in the tub; and a control unit for determining if foam is generated according to a signal voltage difference generated in the foam sensor.

The foam sensor is formed in plural, and at least one foam sensor is mounted on the top and bottom parts of the drum washing machine so as to be electrically connected to each other.

The drum washing machine further includes: a drying duct having a circulating fan and a drying heater so as to supply hot air into the tub; and a condensing duct for condensing the air which has dried laundry in the tub and guiding the same to the drying duct. Part of the plurality of foam sensors may be mounted on the bottom side of the tub, and the rest may be mounted at at least one of the drying duct and the condensing duct.

Additionally, the drum washing machine further includes: a drying duct having a circulating fan and a drying heater so as to supply hot air into the tub; and an exhaust duct for discharging the air which has dried laundry in the tub to the outside. Part of the plurality of foam sensors may be mounted on the bottom side of the tub, and the rest may be mounted at at least one of the drying duct and the exhaust duct.

DETAILED DESCRIPTION OF THE PREFERRED EMBODIMENTS

Hereinafter, embodiments of the present invention will be described in detail with reference to the accompanying drawings.

Figure 1:
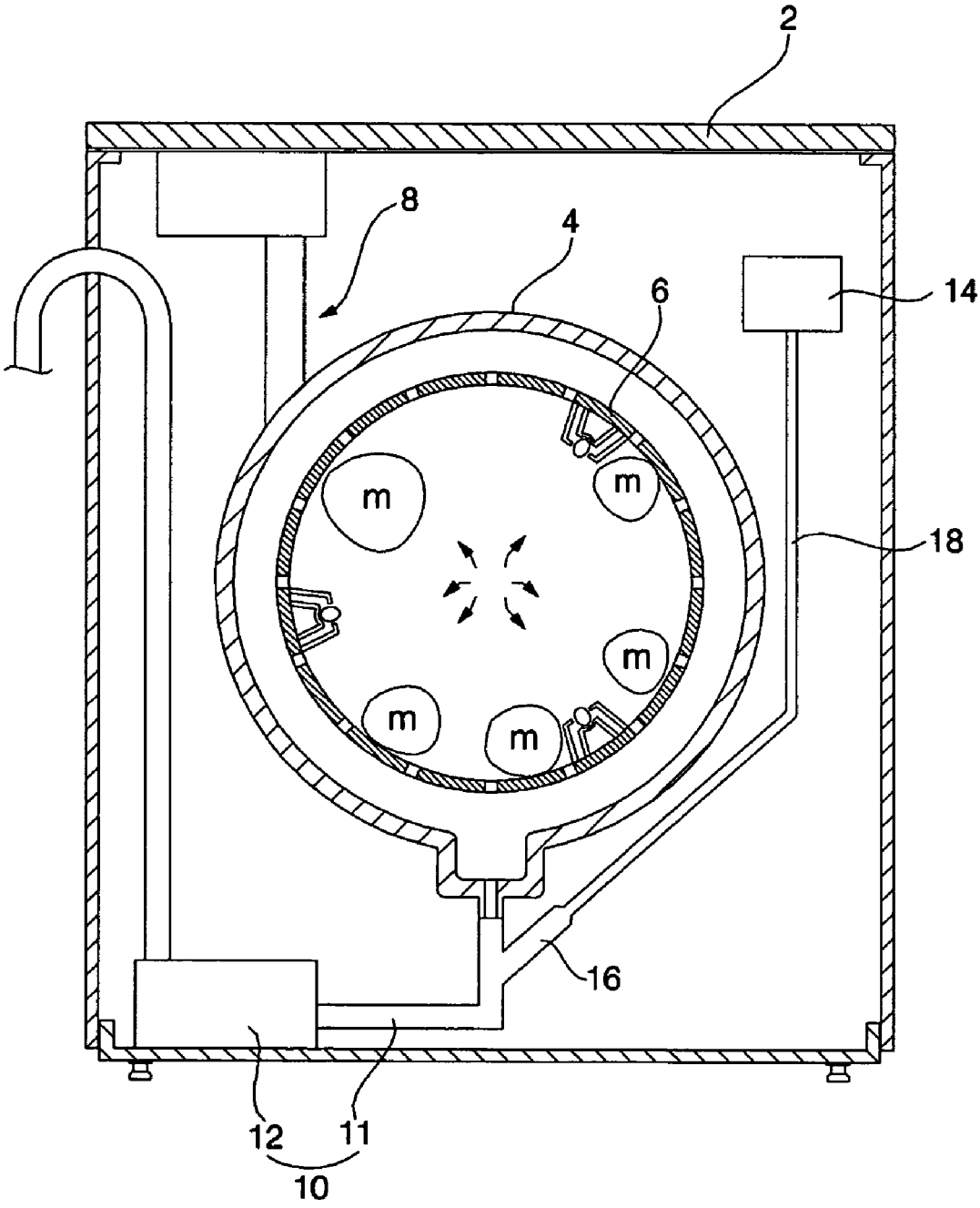
FIG. 1(related art)
FIG. 1 is a front cross sectional view schematically illustrating the interior of a drum washing machine according to the related art.
Figure 2:
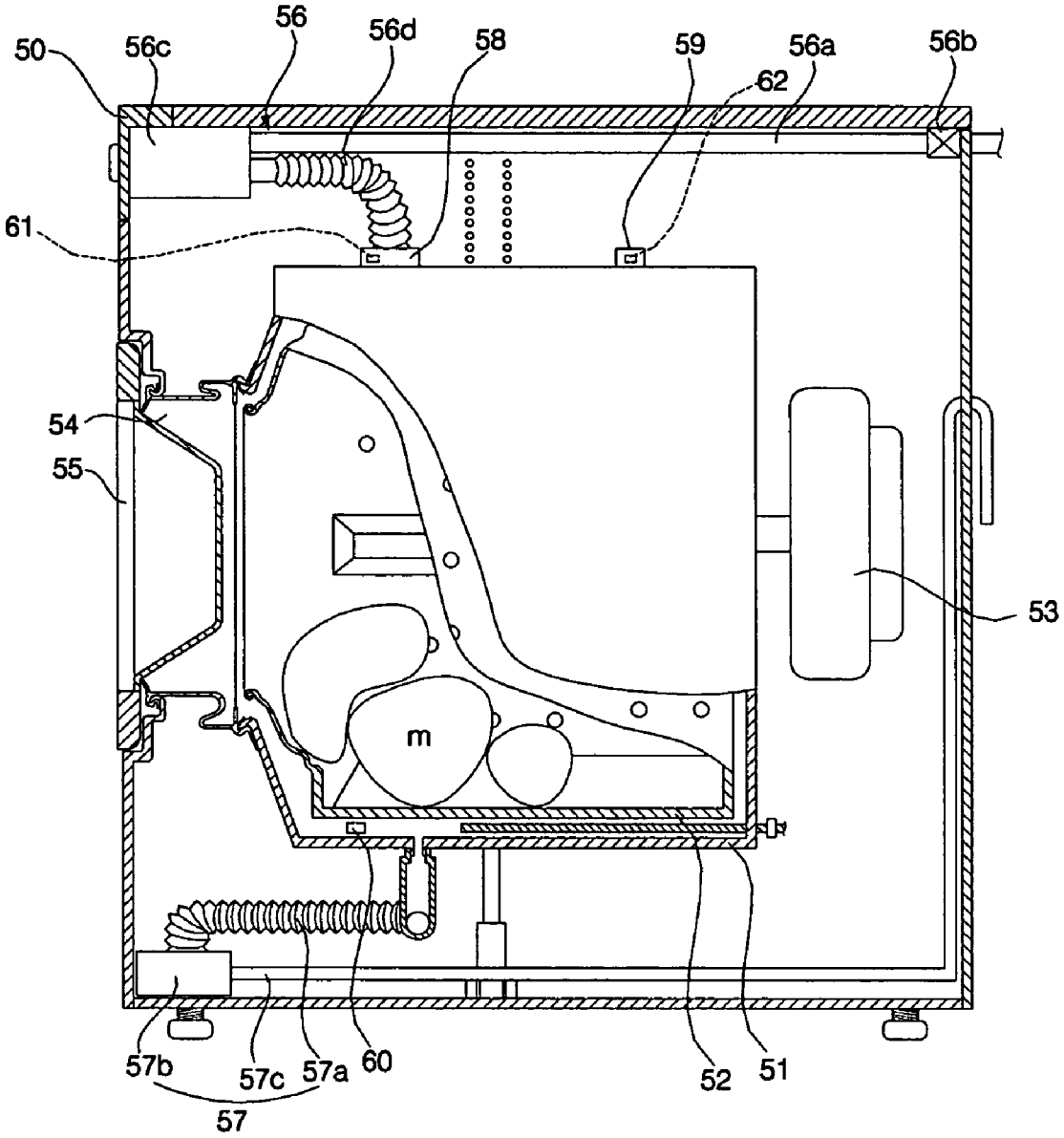
FIG. 2 is a schematic view illustrating the interior of a drum washing machine having a foam sensor according to the present invention.
Figure 3:
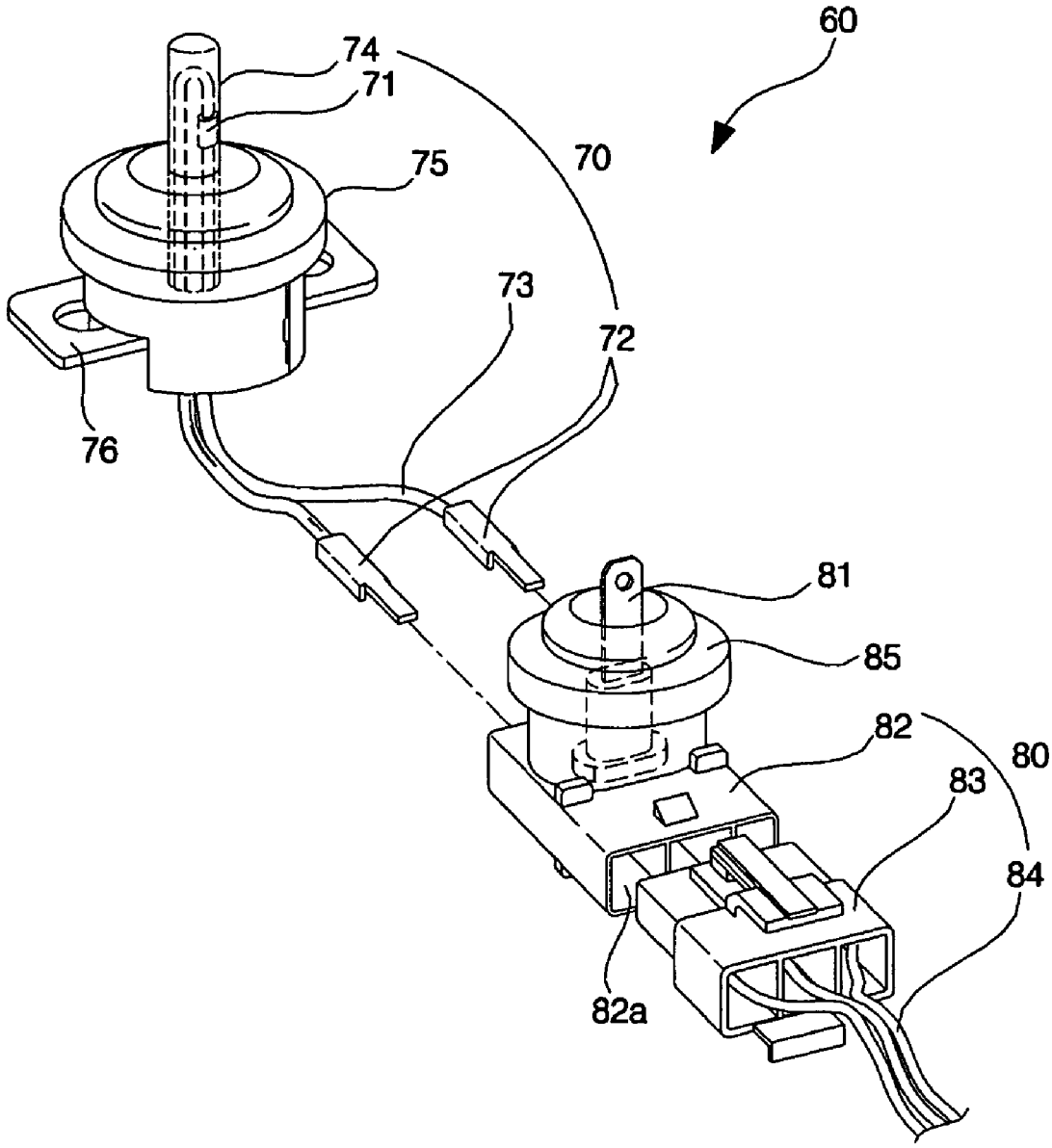
FIG. 3 is an exploded perspective view illustrating a foam sensor according to the present invention.
Figure 4:
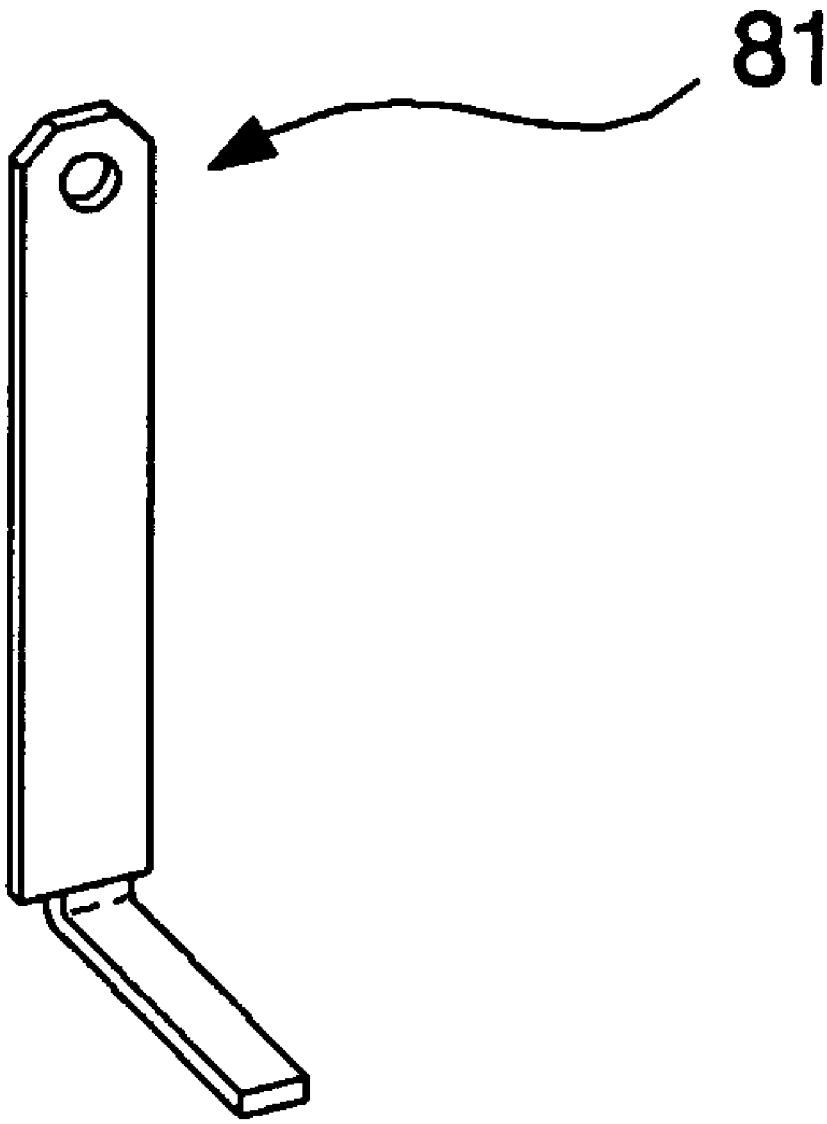
FIG. 4 is a perspective view illustrating a foam electrode terminal used for the foam sensor according to the present invention.

FIG. 2 is a schematic view illustrating the interior of a drum washing machine having a foam sensor according to the present invention. FIG. 3 is an exploded perspective view illustrating a foam sensor according to the present invention. FIG. 4 is a perspective view illustrating a foam electrode terminal used for the foam sensor according to the present invention.

Referring to FIG. 2, the drum washing machine according to the present invention includes a cabinet 50, a tub 51 supported in the cabinet 50, a drum 52 rotatably disposed in the tub 51, and a motor 53 for driving the drum 52.

At the cabinet 50, a laundry inlet and outlet hole 54 for letting laundry m in and out is formed, and a door 55 for opening and closing the laundry inlet and outlet hole 54 is mounted.

To the tub 51, a water supply device 56 for supplying the washing water from the outside into the tub 51 and a drainage device 57 for draining the washing water in the tub 51 to the outside are connected.

The drainage device 56 includes a water supply hose 56*a* for supplying washing water from the outside, a water supply valve 56*b* mounted on the water supply hose 56*a*, for controlling the supply of the washing water, a detergent container 56*c* which the washing water guided to the water supply hose 56*c* passes through, and a water supply bellows 56*d* for guiding the washing water that has passed through the detergent container 56*c*.

The water supply bellows 56*d* is mounted so as to communicate with a water supply port 58 formed at one side of the top of the tub 51.

The drainage device 57 includes a drainage bellows 57*a* connected to the bottom part of the tub 51, for guiding the washing water in the tub 51, a drainage pump 57*b* for pumping the washing water guided to the drainage bellows 57*a*, and a drainage hose 57*c* for guiding the washing water pumped in the drainage pump 57*b* to the outside of the cabinet 50.

An air hole 59*b* for introducing air into the tub 51 is formed on top of the tub 51. The air hole 59 is formed so that in case a child enters into the tub 51, the child can breath, which is preferably formed at the topmost position in the tub 51.

Foam sensors 60, 61, and 62 for sensing foam in the tub 51 are mounted in the drum washing machine. The foam sensors 60, 61, and 62 are formed in plural, and at least one of them is mounted at the top and bottom parts of the drum washing machine so that they can be electrically connected to each other when foam is generated.

In the case of FIG. 2, one of the foam sensors 60, 61, and 62 is mounted at the bottom side of the tub 51, and the rest two of them are mounted on the water supply port 58 and the air hole 59, respectively.

That is, the foam sensors 60, 61, and 62 include a first foam sensor 60 mounted at a bottom side of the interior of the tub 51 and brought in contact with the supplied washing water or foam, a second foam sensor 61 mounted on the water supply port 58 so as to come into contact with foam filling to one side of the interior of the tub 51, and a third foam sensor 62 mounted on the air hole 59 so as to come into contact with foam filling to the other side of the interior of the tub 51.

The drum washing machine includes a control unit (not shown) for determining if foam is generated according to a signal voltage difference generated between the first, second, and third foam sensors 60, 61, and 62.

Each of the foam sensors 60, 61, and 62 includes, as shown in FIG. 3, a temperature sensor 70 positioned at one side of the tub 51, a connector 80 positioned at the other side of the tub 51 and connected to the temperature sensor portion 70, and a foam electrode terminal 81 provided integral with the connector 80, for sensing foam generated in the tub 51.

The temperature sensor portion 70 includes a thermistor 71 for sensing a temperature of washing water and temperature electrode terminals 72 connected to the thermistor 71 and inserted into the connector 80.

Here, the thermistor 71 and the temperature electrode terminals 72 are electrically connected by a first cord 73 so as to be spaced apart at a predetermined gap. The thermistor 71 is covered with a case 74 so as not to be directly contacted with the washing water, and the case 74 is made of synthetic resin material.

The temperature sensor portion 70 further includes a temperature sensor housing 75 formed so as to surround the thermistor 71 covered with the case 74.

The temperature sensor housing 75 is formed in a cylindrical shape whose bottom surface is open, and a fixing plate 76 for fixing the temperature sensor housing 75 to the tub 51 is mounted on the bottom surface.

The connector 80 includes a receptacle 82 provided integral with the foam electrode terminal and a plug 83 coupled to the receptacle by a male/female connection.

The receptacle 82 has a plurality of terminal slots 82*a* for inserting the temperature electrode terminals 72. To the plug 83, a second cord 84 is connected to supply a current to the temperature electrode terminals 72 and the foam electrode terminal 81.

As shown in FIGS. 3 and 4, one end of the foam electrode terminal 81 is inserted and fixed to the terminal slot 82*a*, and the other end thereof is formed in a L-shaped so as to be exposed to the outside of the receptacle 82 and brought in contact with foam.

The receptacle 82 has a foam sensor housing 85 formed so as to surround part of the foam electrode terminal 81.

Although this embodiment has been described with respect to a case where one foam electrode terminal 81 is provided at the connector 80, it is also applicable to a case where two foam electrode terminals 81 are provided so as to form a pair at the connector 80, and the foam sensor is mounted only one side of the interior of the drum washing machine, thereby independently sensing foam.

A method for sensing foam of the drum washing machine thus constructed according to one embodiment of the present invention will be described below.

When a power is applied to the drum washing machine, washing water is introduced into the tub 51 through the water supply device 56. When the washing water fills up the tub 51, the first foam sensor 60 comes into contact with the washing water.

The temperature sensor portion 70 of the first foam sensor 60 senses a temperature of the contacted washing water, and transmits a sensed signal to the control unit (not shown).

At this time, if excessive foam is generated in the tub 51 due to an excessive use of detergent or the like and the foam fills the water supply port 58, the foam comes into contact with the foam electrode terminal of the second foam sensor 61 mounted on the water supply port 58.

Hence, when the foam fills up to the water supply port 59 from the bottom side of the tub 51, the foam serves to electrically connect the foam electrode terminal 81 of the first foam sensor 60 and the foam electrode terminal of the second foam sensor 61. Thus, the resistance between the foam electrode terminal 81 of the first foam sensor 60 and the foam electrode terminal of the second foam sensor 61 becomes rapidly smaller, and the signal voltage difference therebetween becomes also smaller.

When the signal voltage difference between the foam electrode terminal 81 of the first foam sensor 60 and the foam electrode terminal of the second foam sensor 61 becomes "0", it is determined that foam is generated, and the control unit (not shown) performs a foam removal operation in which water supply and drainage are repeated.

Once the foam is removed by the foam removal operation, the electrical connection between the foam electrode terminal 81 of the first foam sensor 60 and the foam electrode terminal of the second foam sensor 61 is cut off.

Therefore, the resistance between the foam electrode terminal 81 of the first foam sensor 60 and the foam electrode terminal of the second foam sensor 61 infinitely increases again, and the signal voltage difference therebetween becomes higher again. Thus, the control unit (not shown) determines that there is no foam, and operates a washing operation.

On the other hand, when foam generated in the tub 51 fills the air hole 59, the foam comes into contact with the foam electrode terminal of the third sensor 62.

Hence, the foam filling up the water supply port 59 from the bottom side of the tub 51 serves to electrically connect the foam electrode terminal 81 of the first foam sensor 60 and the foam electrode terminal of the third foam sensor 62. Thus, the resistance between the foam electrode terminal 81 of the first foam sensor 60 and the foam electrode terminal of the third foam sensor 62 becomes rapidly smaller, and the signal voltage difference therebetween becomes also smaller.

When the signal voltage difference between the foam electrode terminal 81 of the first foam sensor 60 and the foam electrode terminal of the third foam sensor 62 becomes "0", it is determined that foam is generated, and the control unit (not shown) performs a foam removal operation in which water supply and drainage are repeated.

Here, because the distance between the first foam sensor 60 and the second and third foam sensors 61 and 62 is far, no water layer is formed between the first foam sensor 60 and the second and third foam sensors 61 and 62 in a state where no foam is generated, thus preventing a false sensing of foam generation caused by a water layer.

Additionally, the second foam sensor 61 and the third foam sensor 62 are disposed in different positions, even if foam is contacted with only at least either one of the second foam sensor 61 and the third foam sensor 62 before the foam fills in the entire part of the interior of the tub 51, the control unit (not shown) is able to quickly determine if foam is generated.

Additionally, in a case where a contact failure of the connector 80 or a removal of the cord 84 or the like occurs, the electrical connection between the two temperature electrode terminals 72 of the temperature sensor portion 70 is cut off and the circuit configuration is cut off, thereby increasing the resistance of the temperature sensor portion 70 infinitely.

Therefore, once the resistance of the temperature sensor portion 70 infinitely increases, the control unit (not shown) is able to determine if the first, second and third foam sensors 60, 61, and 62 are electrically short-circuited.

The foam electrode terminal 81 is provided integral with the connector 80, and the temperature sensor portion 70 may be disposed so as to be spaced apart at a predetermined gap from the thermistor 71 and the foam electrode terminal 81 while being connected to the connector 80. Thus, the installation locations of the temperature sensor portion 70 and the foam electrode terminal 81 can be differentiated.

Figure 5:
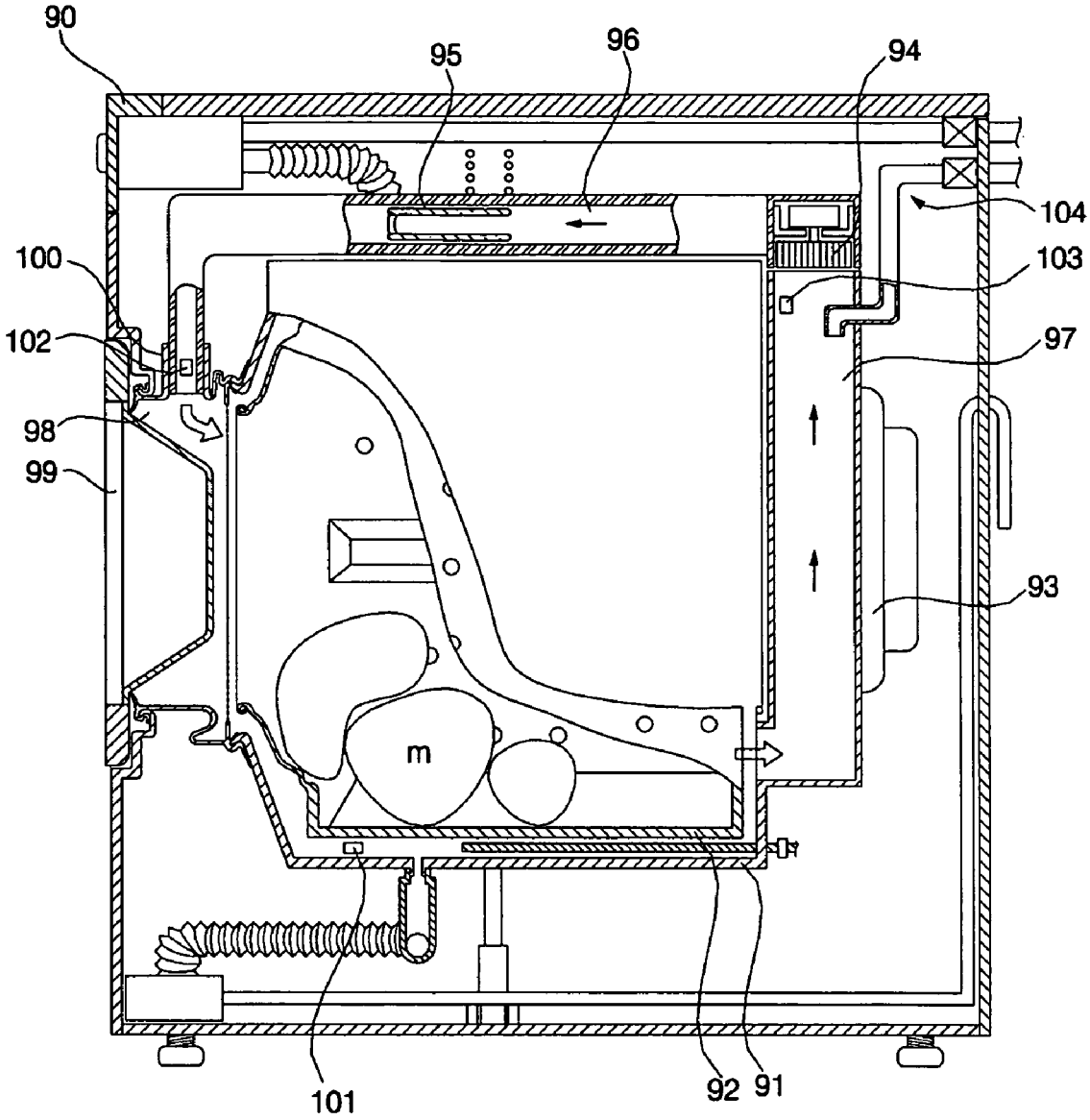
FIG. 5 is a schematic view illustrating the interior of a drum washing machine according to another embodiment of the present invention.

FIG. 5 is a schematic view illustrating the interior of a drum washing machine according to another embodiment of the present invention.

Referring to FIG. 5, the drum washing machine according to the embodiment of the present invention includes a cabinet 90, a tub 91 supported in the cabinet 90, a drum 92 rotatably disposed in the tub 91, and a motor 93 for driving the drum 92, a drying duct 96 having a circulating fan 94 and a drying heater 95 so as to supply hot air into the drum 92, and a condensing duct 97 for condensing the air which has dried laundry (m) in the drum 92 and guiding the same to the drying duct 96.

At one surface of the cabinet 90, a laundry inlet and outlet hole 98 for letting laundry (m) in and out is formed, and a door 99 for opening and closing the laundry inlet and outlet hole 98 is mounted.

To the tub 91, a gasket 100 tightly attached to the door 99 upon closing the door, for preventing laundry, washing water, and air from leaking out between the tub 91 and the door 99 is mounted.

The outlet of the drying duct 96 may be connected to the gasket 100 so as to discharge hot air into the tub 91, and may also be directly connected to the tub 91. This embodiment is described with respect to a case where the outlet of the drying duct 96 is connected to the gasket 100.

A suction portion of the condensing duct 97 is connected to the bottom part of the back surface of the tub 91, a discharge portion thereof is connected to the drying duct 96, and a cooling water supply system 104 for supplying cooling water from the outside is connected to the condensing duct 97.

In this embodiment, the foam sensors 101, 102, and 103 each include a first foam sensor 101 mounted at a bottom side of the interior of the tub 91 and brought in contact with the washing water or foam supplied into the tub 91, and second and third foam sensors 102 and 103 mounted at a position higher than the first foam sensor 101 and electrically connected to the first foam sensor 101 when foam is generated between the first foam sensor 101 and the second and third foam sensors 102 and 103.

The drum washing machine according to this embodiment includes a control unit (not shown) for determining if foam is generated according to a signal voltage difference generated between the first foam sensor 101 and the second and third foam sensors 102 and 103.

Each of the foam sensors 101, 102, and 103 includes a temperature sensor 70 for sensing a temperature of washing water, a connector 80 connected to the temperature sensor portion 70, and a foam electrode terminal 81 provided integral with the connector 80, for sensing foam generated in the tub 91.

Here, the internal construction and operation of this embodiment is the same as the previous embodiment except that the second foam sensor 102 is mounted at the discharge portion of the drying duct 96 so as to come into contact with the foam filling one side of the interior of the tub 91, and the third foam sensor 103 is mounted at the discharge portion of the condensing duct 97 so as to come into contact with the foam filling the other side of the interior of the tub 91. Thus, like reference numerals are used, and detailed description thereof will be omitted.

Figure 6:
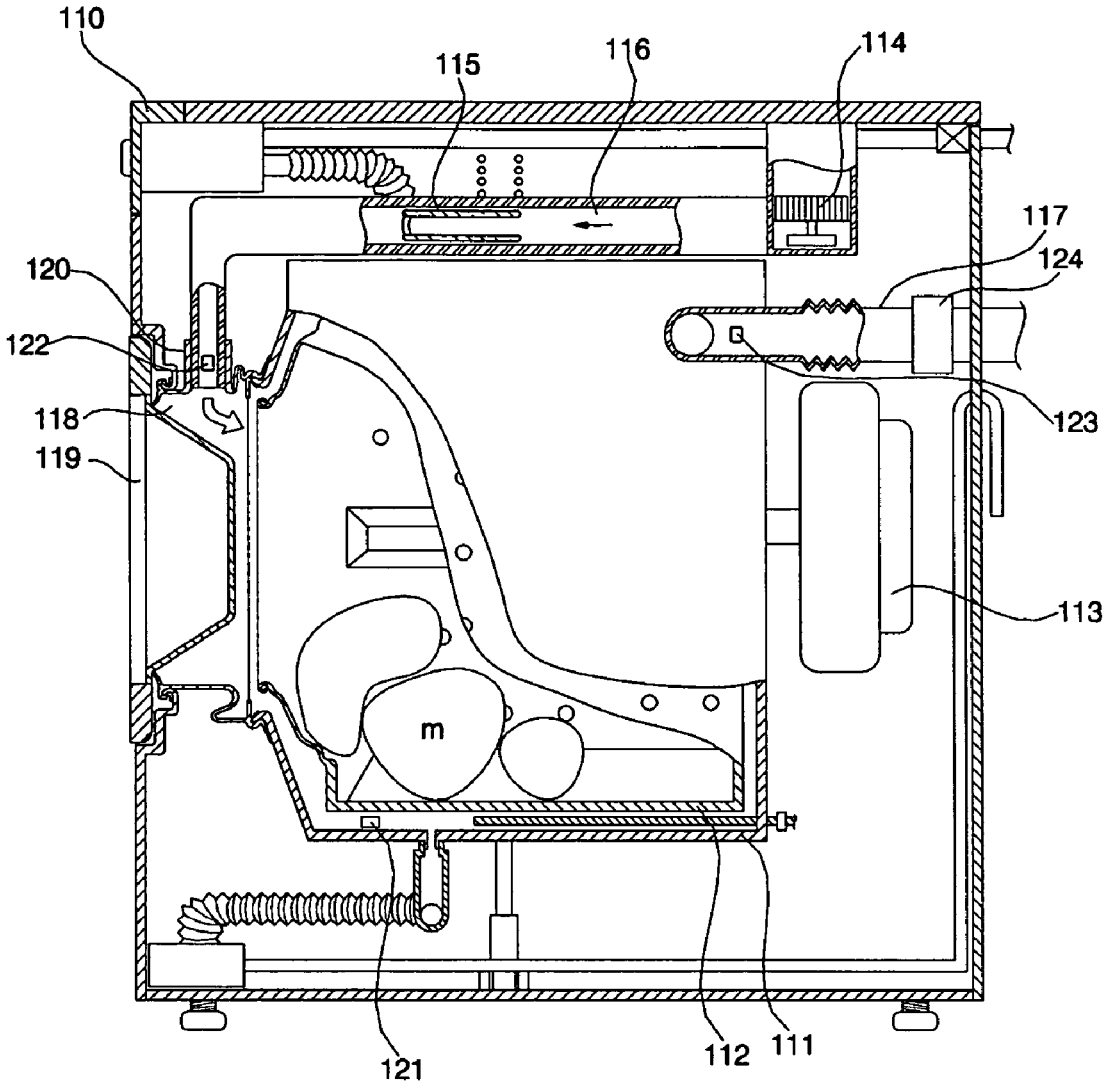
FIG. 6 is a schematic view illustrating the interior of a drum washing machine according to yet another embodiment of the present invention.

FIG. 6 is a schematic view illustrating the interior of a drum washing machine according to yet another embodiment of the present invention.

Referring to FIG. 6, the drum washing machine according to the embodiment of the present invention includes a cabinet 110, a tub 111 supported in the cabinet 110, a drum 112 rotatably disposed in the tub 111, and a motor 113 for driving the drum 112, a drying duct 116 having a circulating fan 114 and a drying heater 115 so as to supply hot air into the drum 112, and an exhaust duct 117 for discharging the air which has dried laundry (m) in the drum 112 to the outside.

At one surface of the cabinet 110, a laundry inlet and outlet hole 118 for letting laundry (m) in and out is formed, and a door 119 for opening and closing the laundry inlet and outlet hole 118 is mounted.

To the tub 111, a gasket 120 tightly attached to the door 119 upon closing the door, for preventing laundry, washing water, and air from leaking out between the tub 111 and the door 119 is mounted.

The outlet of the drying duct 116 may be connected to the gasket 100 so as to discharge hot air into the tub 111, and may also be directly connected to the tub 111. This embodiment is described with respect to a case where the outlet of the drying duct 116 is connected to the gasket 120.

The exhaust duct 117 is connected to the rear part of the top of the tub 111, and a filter 124 for purifying the air which has dried the laundry is mounted on the exhaust duct 117.

In this embodiment, the foam sensors 121, 122, and 123 includes a first foam sensor 121 mounted at a bottom side of the interior of the tub 111 and brought in contact with the washing water or foam supplied into the tub 111, and second and third foam sensors 122 and 123 mounted at a position higher than the first foam sensor 121 and electrically connected to the first foam sensor 121 when foam is generated between the first foam sensor 121 and the second and third foam sensors 122 and 123.

The drum washing machine according to this embodiment includes a control unit (not shown) for determining if foam is generated according to a signal voltage difference generated between the first foam sensor 121 and the second and third foam sensors 122 and 123.

Each of the foam sensors 121, 122, and 123 includes a temperature sensor 70 for sensing a temperature of washing water, a connector 80 connected to the temperature sensor portion 70, and a foam electrode terminal 81 provided integral with the connector 80, for sensing foam generated in the tub 111.

Here, the internal construction and operation of the first, second, and third foam sensors 121, 122, and 123 is the same as the previous embodiment except that the second foam sensor 122 is mounted at the discharge portion of the drying duct 116 so as to come into contact with the foam filling one side of the interior of the tub 111, and the third foam sensor 123 is mounted in the exhaust duct 117 so as to come into contact with the foam filling the other side of the interior of the tub 111. Thus, like reference numerals are used, and detailed description thereof will be omitted.

As described above, according to the present invention, the foam sensor of the drum washing machine is constructed such that a pair of temperature electrode terminals and a foam electrode terminal are supplied with electricity by a single connector, and thus is able to sense an electrical connection by a signal change of the temperature electrode terminals, in a case where electrical connection of the foam electrode terminal is cut off, thereby preventing a false sensing of foam generation caused by electrical short-circuiting of the foam electrode terminal.

Furthermore, the foam electrode terminal is provided integral with the connector, and the temperature sensor portion has a thermistor for sensing a temperature of washing water and temperature electrode terminals inserted into the connector, the thermistor and the temperature electrode terminals being connected by a cord, which makes installation easier.

Furthermore, the foam sensor is constructed such that a plurality of foam sensors are mounted at different positions and determine if foam is generated according to a signal voltage difference generated therebetween, and thus is able to quickly sense if foam is generated before foam fills up the entire part of the interior of the tub, thereby preventing excessive generation of foam.

Furthermore, a condensing type drier and washing machine according to the present invention is able to sense if foam is generated before foam fills up the interior of the drying duct, and thus an outlet flow is reduced due to the foam filing up the interior of the exhaust duct, thereby preventing deterioration of the drying function.

Although the invention has been described with respect to exemplary embodiments, the invention is not limited to the specific embodiments described above, and it will be apparent to those skilled in the art that various modifications are possible without departing from the spirit and scope of the invention as defined by the appended claims. Such modifications are not to be regarded as a departure from the technical spirit and prospect of the invention

What is claimed is:

1. A foam sensor of a drum washing machine, comprising:

a temperature sensor portion configured to sense a temperature of washing water supplied into a tub, wherein the temperature sensor portion comprises:

a thermistor for sensing a temperature of washing water;

temperature electrode terminals connected to the thermistor; and a first cord for connecting the thermistor to the temperature electrode terminals electrically, a foam electrode terminal configured to sense foam generated in the tub;

a plug connected to a second cord through which a current from an external current source is supplied to the temperature sensor portion and the foam electrode terminal; and a receptacle at which the foam electrode terminal is installed and into which the temperature electrode terminals are inserted such that the current supplied by the plug is provided to the temperature electrode terminals as well as the foam electrode terminal.

2. The foam sensor of claim 1, wherein the temperature sensor portion further includes a temperature sensor housing formed so as to surround the thermistor.

3. The foam sensor of claim 1, wherein the foam electrode terminal is formed in plural.

4. The foam sensor of claim 1, wherein the receptacle is formed integral with the foam electrode terminal and having a terminal slot for inserting the temperature electrode terminals.

5. The foam sensor of claim 4, wherein one end of the foam electrode terminal is inserted and fixed to the terminal slot, and the other end thereof is formed to be exposed to the outside of the receptacle.

6. The foam sensor of claim 4, wherein the receptacle has a foam sensor housing formed so as to surround part of the foam electrode terminal.

* * * * *